United States Patent [19]

Schick

[11] 4,333,701

[45] Jun. 8, 1982

[54] IN LINE CARTRIDGE TYPE FUSE HOLDER

[75] Inventor: Henry Schick, Commack, N.Y.

[73] Assignee: Gilbert Mfg., Co., Inc., Long Island City, N.Y.

[21] Appl. No.: 259,587

[22] Filed: May 1, 1981

Related U.S. Application Data

[63] Continuation-in-part of Ser. No. 54,001, Jul. 2, 1979, abandoned.

[51] Int. Cl.[3] ..... H01R 13/38

[52] U.S. Cl. ..... 339/97 P; 339/147 R

[58] Field of Search ..... 339/19, 97 R, 97 P, 339/98, 99 R, 147

[56] References Cited

U.S. PATENT DOCUMENTS

| | | | |
|---|---|---|---|
| 1,500,641 | 7/1924 | Sabourin | 339/97 P |
| 3,766,514 | 10/1973 | Kimm | 339/99 R |
| 4,062,615 | 12/1977 | Navarro | 339/98 |

FOREIGN PATENT DOCUMENTS

| | | | |
|---|---|---|---|
| 699856 | 11/1953 | United Kingdom | 339/98 |

*Primary Examiner*—Joseph H. McGlynn
*Attorney, Agent, or Firm*—Darby & Darby

[57] ABSTRACT

An in-line fuse holder having a first body section into which an insulated conductor which has been cut is placed, there being piercing type terminals provided in a second body section to pierce the insulation and to make connection with the two ends of the cut conductor. The second body section contains a cartridge type whose conductive ends are held in clip-type terminals with the body of the fuse viewable through a cutout which permits a viewer to see if the fuse has been blown. The two sections of the body are formed as an integral unit connected by a hinge and a cover for the cut ends also can be formed at the same time as the body sections.

10 Claims, 12 Drawing Figures

IN LINE CARTRIDGE TYPE FUSE HOLDER

RELATED APPLICATION

This application is a continuation-in-part of my prior copending application Ser. No. 54,001 filed July 2, 1979, which is assigned to the same assignee, and now abandoned.

In many cases of operating electrical devices, a need or desire arises to fuse a power supply line. This is true with devices which operate at low voltage, such as, for example, automobile radios and CB transceivers, as well as with appliances operating from normal household current and, also, Christmas tree light sets, etc. In many of these applications, so-called cartridge type fuses are used.

One typical arrangement for using a cartridge type fuse is a so-called bayonet type fuse holder which has two separable parts a body and a cap, with a lead wire extending from each part. The fuse is located in the body and the cap is unscrewed from the barrel by a spring-loaded bayonet action. Such bayonet holders are relatively costly and, also, are not visually attractive. Further, there is no provision to view the condition of the fuse. Also, soldered or twisted wire connections must be made to connect the fuse into the line. In the case of appliances which are operated from a line cord, a fuse is sometimes provided in the plug which is to be inserted into the wall socket. This arrangement also has a disadvantage in that the plugs are rather costly and require a relatively large number of parts. Further, to change the fuse requires disassembly of the plug and there is no provision made to view the condition of the fuse.

The present invention relates to a novel in-line fuse holder which can be used in either one or two conductor power lines. In accordance with the invention, the fuse holder is formed of plastic material, and preferably has two sections which are hingedly connected to each other. One section of the body is adapted to hold the conductor which is to be fused, the conductor having previously been severed and, in the case of a two-conductor device, the other conductor. The second section holds a pair of piercing type electrical terminals which are adapted to pierce through the insulation of the conductor and make electrical contact with the wire. A cartridge type fuse is held between the piercing type terminals of the second section which is provided with a window for viewing the fuse. The two sections are connected by a hinge and a locking arrangement is provided for the two sections.

It is therefore an object of the present invention to provide a novel in-line fuse holder.

A further object is to provide an in-line fuse holder which can be connected in series in an electrical supply line without soldering or twisting of wires.

Another object is to provide an in-line fuse holder which makes contact with the electrical conductor of a one or two wire conductor pair by piercing type contacts.

An additional object is to provide a two-section in-line fuse holder which is hinged together with a catch being provided to hold the two sections together.

A further object is to provide an in line fuse holder integrally molded with two sections and a cover for the cut ends of the conductor.

Other objects and advantages of the present invention would become more apparent upon reference to the following specification and annexed drawings in which.

Figure 1:
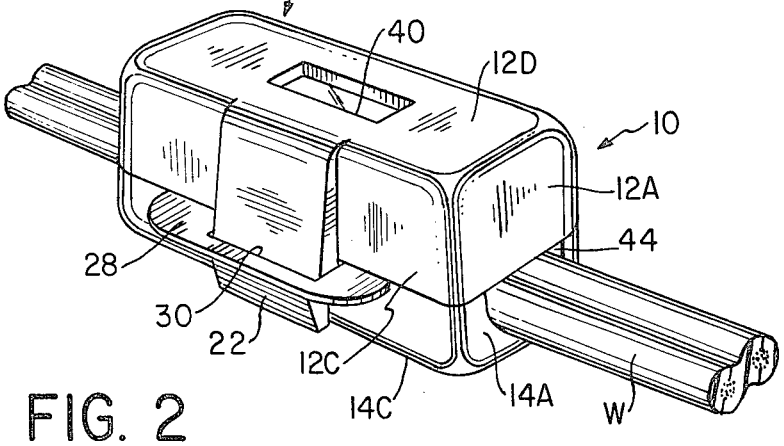
FIG. 1 is an overall perspective view of a preferred embodiment of the fuse holder.
Figure 2:
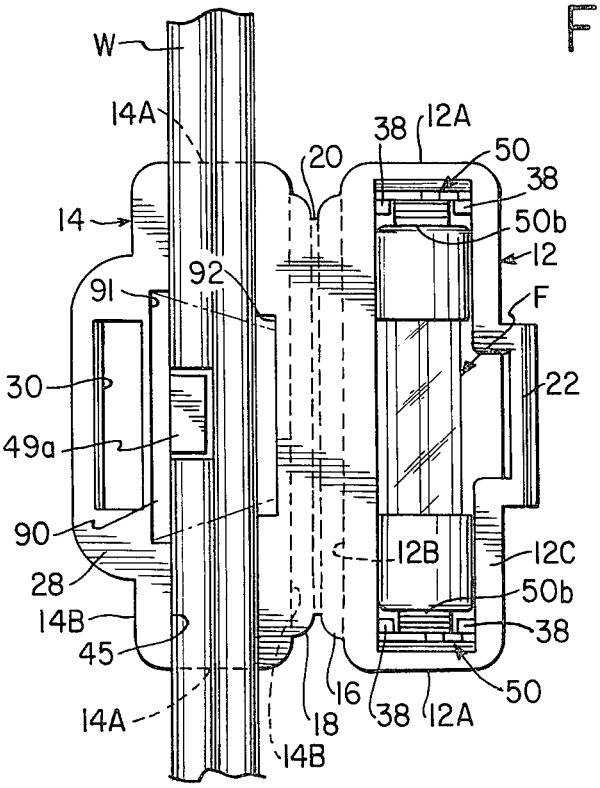
FIG. 2 is a plan view showing the two sections of the fuse holder unfolded.
Figure 3:
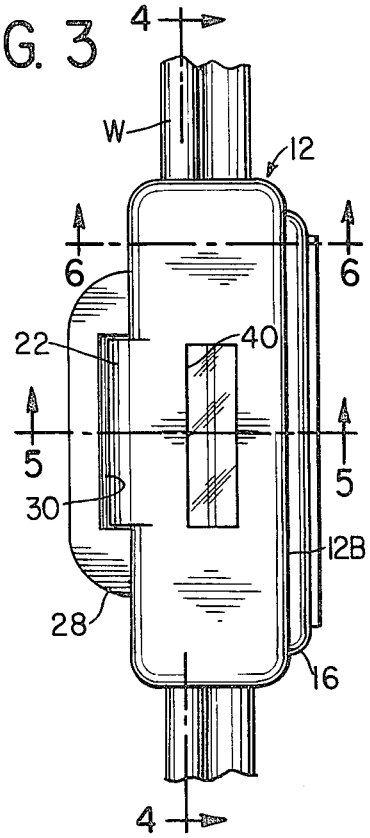
FIG. 3 is a side elevational view of an assembled fuse holder.

Referring to the drawings, and particularly FIGS. 1–3, the fuse holder 10 is formed by a molded body of a suitable insulating material, one such being polypropylene or ABS plastic. The molding is done, for example, by injection molding. The holder is formed with two sections 12 and 14 which are preferably molded in one piece. One side wall 12B, 14B of the respective sections 12 and 14 has a respective extending rib 16,18, the ribs being joined together by a hinge piece 20 which permits the two sections 12 and 14 to be folded and unfolded relative to each other.

Figure 5:
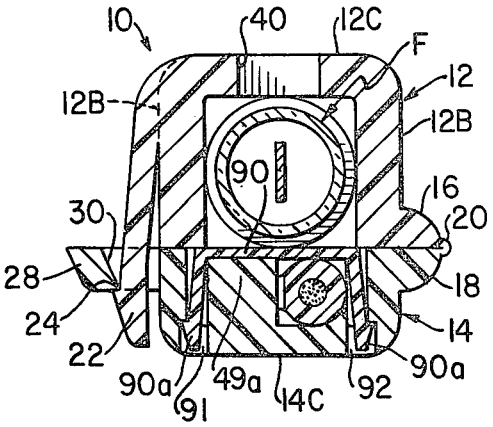
FIG. 5 is a cross-section view of the assembled holder taken along line 5—5 of FIG. 3.
Figure 6:
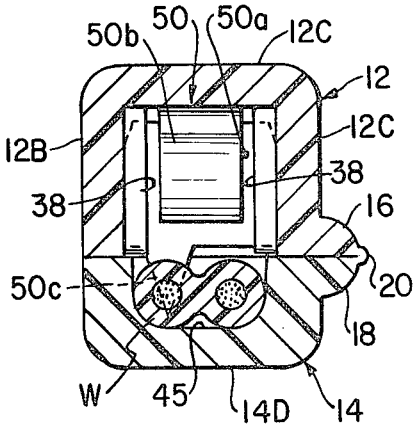
FIG. 6 is a cross-sectional view of the assembled holder taken along lines 6—6 of FIG. 3.
Figure 7:
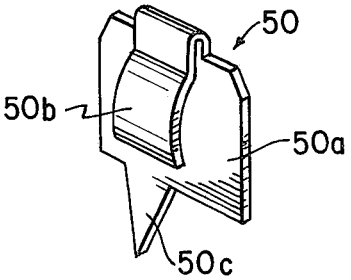
FIG. 7 is a perspective view of one of the terminals.

The other side wall 12C, 14C of the respective sections 12 and 14 is formed with a fastening device. In the embodiment shown (see FIG. 5), section 12 is formed with a downwardly extending tab 22 having a shoulder 24 thereon. Section 14 is formed with an arcuate-shaped piece 28 having a hole 30 therein. As seen in FIG. 5, the two sections 12 and 14 are fastened together by inserting the tab piece 22 into the opening 30 and locking them.

Figure 4:
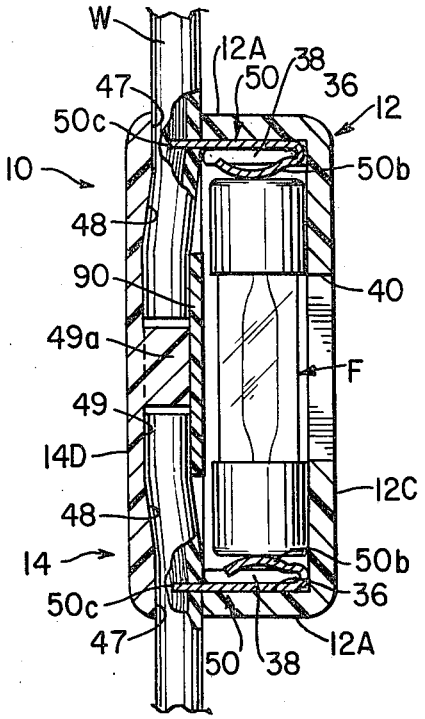
FIG. 4 is a side elevational view, in cross-section of the fuse holder.

As shown in FIGS. 2 and 4, the interior of section 12 is formed with a compartment 36 adjacent each end wall 12A by an abutment 38 on each side wall 12B and 12C. As discussed below, each compartment 36 holds a piercing type terminal contact. The top wall 12D has a fuse inspection window 40 formed therein. Window 40 is open and also provides access to the fuse so that it can be pushed out by inserting a tool through the window when the two sections are apart. A fuse holding chamber is formed in section 12 between the two compartments 36.

Section 14 has each of its end walls 14A formed with a cutout 44 of a width of the line to be accepted. Cutout 44 extends down to the bottom wall 14D. A two conductor line is shown. A channel 45 is formed in the bottom wall 14D which is the width of the two conductor line. As seen best in FIG. 4, the bottom wall 14D has the greatest thickness at the entrance portion 47 and has a downwardly tapering portion 48 from each entrance portion and a flat central portion 49.

A generally rectangular separator **49*a* is molded on the bottom wall 14D in the channel 45. The separator provides insulation between the cut ends of one of the conductors W of the two conductor line. If a single conductor line is to be fused, the width of channel 45** can be decreased.

A bladed contact terminal 50 is provided for each of the compartments 36 of section 12. Each of the bladed contact terminals is of a suitable electrically conductive material, for example, spring brass, etc. Each terminal 50 has a generally rectangular flat portion 50*a* for wedging into the side walls 12B and 12C of a terminal compartment 36. Each terminal is also formed with a folded over portion 50*b* which provides electrical contact for the fuse. A barb, or point, 50*c* is formed on the bottom of each terminal to pierce the insulation of the conductor W to make contact with the wire.

The assembly of the holder is as follows. The body 10 is molded by any suitable process, for example, injection molding. The blade contact terminals 50 are formed and inserted in each compartment 36. A cartridge type fuse F is laid in the chamber between two terminals 50, making electrical contact therewith. The fuse is held securely by the spring action of the terminal tabs 50*b*.

The conductor W which is to be fused is taken and one of the conductors is cut, preferably removing a small piece, for example, on the order of about ¼ inch. If the conductor to be fused is part of a two conductor line, only one of the conductors is cut. The line is then laid in the channel 45 of housing section 14. Since the channel 45 is of a width which is to accommodate the two conductor line which is to be laid therein, the line will be held relatively stationary. The presence of the sloping bottom wall portions 47, 48 also acts in keeping the line stationary.

The cut ends of the one conductor W abut or lie adjacent the separator 49*a*. This prevents the wires of the cut conductor from coming into contact.

As shown in FIGS. 2, 4 and 5, it is sometimes desirable to provide a cover 90 for the ends of the conductor which was severed. This is accomplished by forming a slot 91, 92 in the bottom wall 14C area which lies on each side of the conductor channel 45. Cover 90, which preferably is made of plastic, is generally triangular in shape with a cut off top portion. Each leg of cover 90 is formed with a latching lug 90*a* which engages a shoulder formed on the wall 14C of the respective slot 91 and 92. Cover 90 provides further stability for the line in channel 45.

The fuse F is next placed into the compartment of section 12. It is held between the two contact portions 50*b*. With the line laid in section 14 and housing 12 separated therefrom, there is no possibility of electrical shock from the exposed fuse since no part of the fuse is receiving current. To connect the fuse into the circuit, it is only necessary to close section 12 relative to section 14. At the time this is done, the barb 50*c*, on the end of each of the contact members 50 pierces through the insulation of the conductor W and makes contact with the current carrying wire therein. This connects fuse F in series with the conductor which was cut, that is the fuse bridges the cut ends of the conductor. The fastening members 22–24 and 28 of the two sections are then snapped together, forming a firm closure with full electrical contact being made with the conductor W laid in section 14.

The fuse F is viewed through the window 40 to determine whether or not it is operative. This provides a further advantage in that it is not necessary to disassemble the device to see if the fuse has been blown.

Changing a blown fuse is simple. It is only necessary to unfasten the catch 22–24, 28 and to separate the two sections 12 and 14. The fuse is then removed from section 12. This can be done with safety since there is no current flowing in section 12. The point of a screwdriver or other tool can be pushed through window 40 to move the fuse out of section 12. The fuse is replaced and the two sections 12 and 14 are again snapped together.

Figure 8:
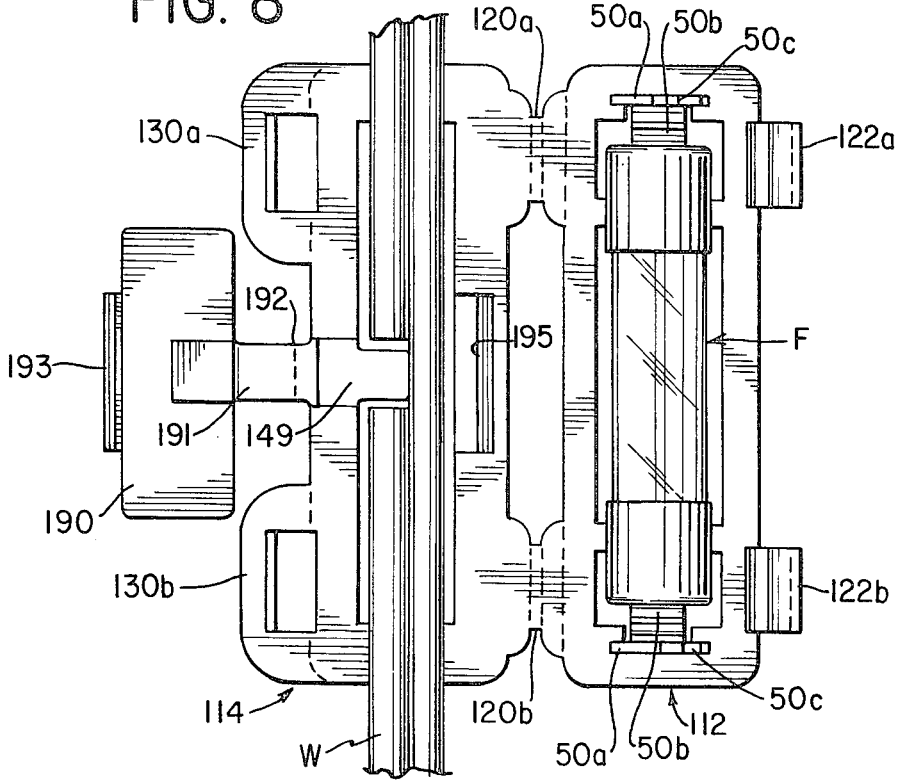
FIG. 8 is a plan view of another embodiment with the sections unfolded.
Figure 9:
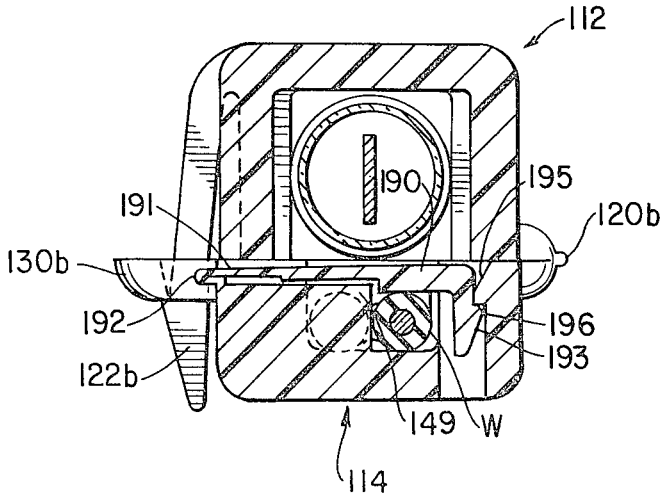
FIG. 9 is a cross-sectional view of the holder of FIG. 8 when closed.

FIGS. 8 and 9 show a further modification of the invention. The body is formed of the two sections 112 and 114. Here, the locking arrangement has been split into two parts, designated as upper and lower catches 130*a* and 130*b* and locking members 122*a* and 122*b*. As before, the body sections 112 and 114 are molded with a hinge which is now split into two sections, 120*a* and 120*b*. A cover 190 is attached to section 114 of the body portion by an extending tang 191 which is connected at a hinge line 192 to the body section 114. All three pieces, 112, 114 and 190 can be molded at the same time.

The cover 190 is formed with a locking lip 193 and the side wall of the section 114 is formed with a slot 195 having a locking ledge 196. To use the cover it is only necessary to fold it over its hinge line 192 and to insert its locking tab 193 into the slot 195 and lock it with the ledge 196, as shown in FIG. 9. The remainder of the construction of the device and the operation with respect to inserting the fuse and making electrical contact with wire W is as described previously.

Figure 10:
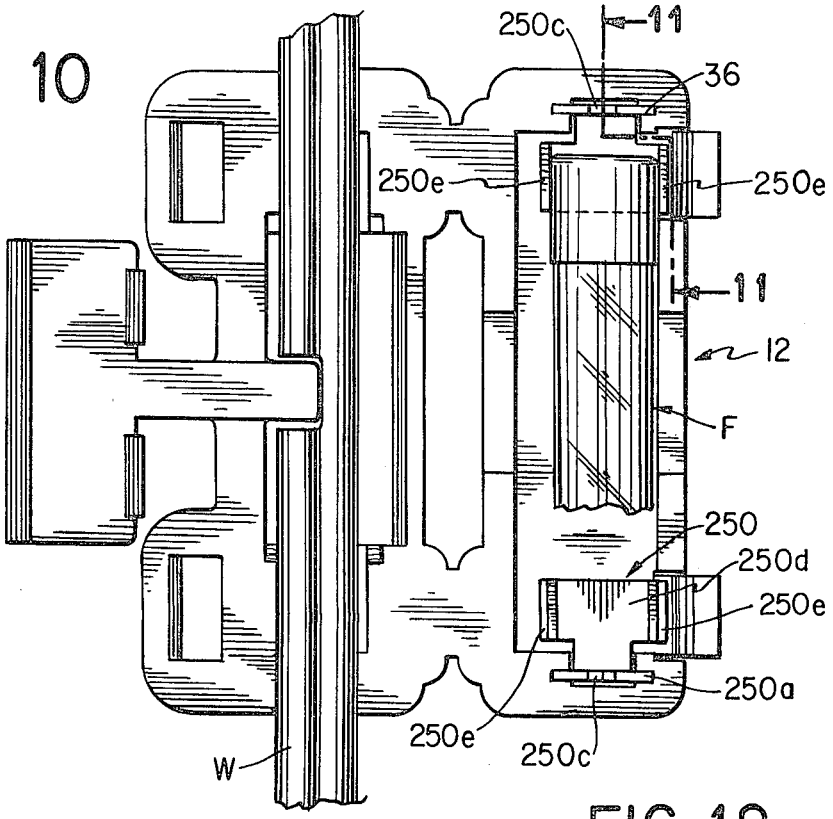
FIG. 10 is plan view of a further embodiment of the fuse holder showing the two-sections unfolded.
Figure 11:
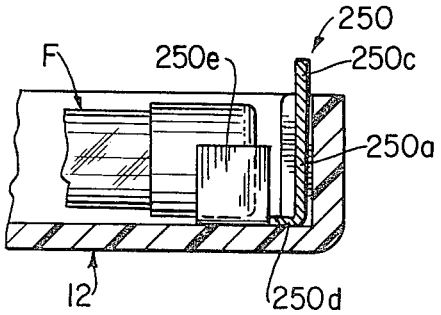
FIG. 11 is a sectional fragmentary view of one end of the fuse holder of FIG. 10.
Figure 12:
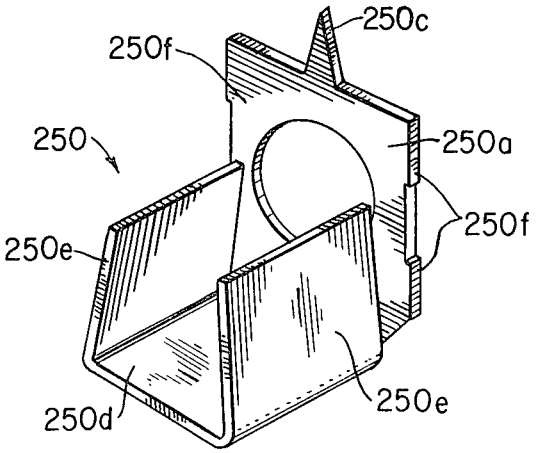
FIG. 12 is a perspective view of one of the terminals.

FIGS. 10–12 show a further embodiment. Here a terminal 250 is provided at each end of the body section 12. Each terminal 250 has the piercing prong 250*c* extending upwardly from a central section 250*a*. A bottom piece 250*d* extends at an angle from the center piece 250*b* and an arm 250*e* extends upwardly from each side of bottom piece 250*d*. The arms 250*e* are resilient to form a spring-like clip therebetween.

The central section 250*a*is formed with projections 250*c* on each side so that the terminal 250 can be tightly wedged into the slot 36 at each end of the housing. With the terminals 250 inserted, each pair of arms 250*c* serves as a clip into which the metal end caps of the fuse can be inserted and held. The terminal 250 has an advantage over that of FIGS. 1–9, in which electrical contact is made only with the end face of each end cap of the fuse, since the larger area metal to metal contact between the terminals and the fuse caps provides a heat sinking action. Thus, the current rating of the fuse holder can be increased.

As seen, a novel in-line fuse holder is provided for cartridge type fuses, which holder is relatively simple in its construction, and thereby economical to produce, and is easy to insert into the current carrying line.

What is claimed is:

1. An in-line holder for cartridge type fuses of the type which are elongated and have an electrically conductive piece at each end and a central section of electrically insulating material comprising:

an elongated body of an electrically insulating material formed by first and second sections, means formed in said first section adapted for holding a current carrying insulated line having one conductor which is cut leaving two spaced opposing ends, a terminal contact mounted in and adjacent each end of said second section in spaced relatlinship at a distance to permit the cartridge fuse to be removably held therebetween, each said terminal contact including means adapted for holding and making electrical contact with a respective conductive piece of the cartridge type fuse located between the terminal contacts, each of said terminal contacts also having formed thereon a barbed end for extending into said first section when the two sections are juxtaposed and each barbed end adapted to pierce through the insulation of the cut conductor of the insulated line held in said first section at a respective one of its cut ends to make electrical contact with the current carrying wire therein, said first and second sections being formed as an integral unit with hinge means for connecting said two sections, and coacting fastening means formed on the exterior of said first and second sections for holding said two sections juxtaposed together with the barbed end of each terminal contact in a position in said first section to pierce through the insulation of the respective corresponding end of the cut conductor to place the fuse held in said second section in the cut line, separation of the two sections removing said terminal contacts from the cut conductor ends and thereby removing current from the cartridge fuse.

2. An in-line holder as in claim 1 wherein a window is provided in said second section at a position opposite the place where the cartridge fuse is to be placed to provide visible access to the central section of the fuse and physical access thereto to permit it to be pushed out of said second section.

3. An in-line holder as in claim 1 wherein each of said body sections has first and second side walls and a pair of end walls, said hinge means being formed to connect the respective first side walls of each of said sections, and said co-acting fastening means located on the second side walls of each of said first and second sections, each of said terminal contacts located adjacent a respective end wall of said second section.

4. An in-line holder as in claim 1 wherein each of said body sections has first and second side walls and a pair of end walls, said first section also having a bottom wall, said means of said first section for holding the wire comprising an opening in each of said first section end walls to permit entrance and exit of the wire, a flat intermediate section formed on said first section bottom wall, and a downwardly sloping portion on said bottom wall between a respective end wall opening and said flat intermediate section to provide strain relief.

5. An in-line holder as in claim 1 wherein said wire holding means of said first section comprises a channel formed in said first section, a separator piece formed in said channel to lie between the ends of the cut conductor, and a cover means of electrically insulating material for overlying said separator piece and the cut ends of the conductor, said cover means also being formed integral with said first and second sections and connected to one of said sections by hinge means.

6. An in-line holder as in claim 1 wherein said wire holding means of said first section comprises a channel formed in said first section, and a separator piece formed in said channel to lie between the ends of the cut conductor.

7. An in-line holder as in claim 6 further comprising cover means of electrically insulating material, and means for holding said cover means to said first section to overlie said separator piece and said cut ends of the conductor.

8. An in-line holder as in claim 1 wherein said holdlng means of said contact terminals comprises at least one of said contact terminals having resilient means to engage and hold the cartridge fuse.

9. An in-line holder as in claim 8 wherein said resilient means comprises a portion which engages the end face of each said conductive end piece.

10. An in-line holder as in claim 8 wherein said resilient means comprises a pair of arms between which a said conductive end piece of the fuse is adapted to be held with the arms engaging a substantial portion of the said conductive end piece.

* * * * *